US006018974A

United States Patent [19]

Potthoff et al.

[11] Patent Number: 6,018,974

[45] Date of Patent: Feb. 1, 2000

[54] ROLLER GUIDE FOR A ROLL STAND

[75] Inventors: Heinrich Potthoff, Hilden; Wilfried Schoeneberg, Duesseldorf, both of Germany

[73] Assignee: Kocks Technik GmbH & Co., Hilden, Germany

[21] Appl. No.: 09/294,468

[22] Filed: Apr. 20, 1999

[30] Foreign Application Priority Data

Apr. 22, 1998 [DE] Germany ..... 198 17 977

[51] Int. Cl.[7] ..... B21B 39/20; B21J 13/08

[52] U.S. Cl. ..... 72/250; 226/189; 72/420

[58] Field of Search ..... 72/250, 227, 419, 72/420, 426, 428, 251, 252; 226/180, 190, 187, 189, 191; 242/615.3

[56] References Cited

FOREIGN PATENT DOCUMENTS 33 06 579 A1 8/1984 Germany .

*Primary Examiner*—Rodney Butler

*Attorney, Agent, or Firm*—Michael J. Striker

[57] ABSTRACT

A roller guide for a roll stand for precise guiding of a rod-shaped or wire-shaped rolling product in a caliber opening formed by rolls which engage the rolling product from an outer side and are distributed on its periphery, the roller guide has angular levers provided with legs on which the rollers are rotatably supported, turning pins on which the angular levers are turnable and which have turning axes extending transversely to a roll axis, an adjusting bushing by which the levers are jointly turnable so as to jointly displace the rollers radially to the roll axis, a coupling rod arranged between the adjusting bushing and each of the levers, the coupling rod being hingedly engaged on a leg of the lever which faces away from the rollers, and an angle between an engaging point between the coupling rod on the lever and a rotary axis of the roller with an apex point on the turning axis of the turning pin amounting to between 80 and 92°.

9 Claims, 2 Drawing Sheets

ROLLER GUIDE FOR A ROLL STAND

BACKGROUND OF THE INVENTION

The present invention relates to roller guides for roll stands.

Roller guides are arranged in many cases on roller stands for rolling of rod—and wire-shaped rolling products, to guide a rolling product exactly centrally in a caliber opening formed by the rollers. Moreover the roller guides which are arranged as close as possible before the caliber opening serve for placing the individual peripheral portions of the rolling product on peripheral portion of the caliber opening provided for it, or in other words for preventing tilting of the rolling product around its longitudinal axis. Both guiding objectives must be fulfilled with high precision. Finally, the rollers of the roller guide must firmly embrace the rolling products, which however does not change in its cross-section. This requires an exact adjustment of each individual roller of the roller guide, which as a rule is performed in a plant apart from the roller train formed by the roller stands. Also, roller guides are known, in which the rollers can be jointly adjusted radially to the rolling product, that is possible with roller guides which are already built in the roll train.

It is therefore an object of the present invention to provide a roller guide for a roll stand for precise guiding of rod and wire shaped rolling products in a caliber opening formed by the rolls, with several rollers which engage the rolling product from the outer side and distributed are over its Periphery, which are rotatably supported in or on legs of an angular lever, which are turnable around turning pins whose turning axes extend transversely to the roll axis, wherein the levers by means of an adjusting bushing displaceable in direction of the roll axis are jointly turnable and thereby the rollers are jointly displaceable radially to the roll axis.

The German patent document DE 33 06 579 Al discloses a roller guide of similar art, which must be utilized however not on roll stands, but instead together with testing devices. This known roller guide has a relatively great axial length and is therefore not suitable for roll stands in roll trains, since there shortest possible distances must be maintained between the roll stands which is not possible with the known roller guide. Moreover, in this known roller guide, elastic springing of the caliber opening of the roller during passage of the rolling product is fixed by the shape of the components, in particular by its levers, and can not be adjusted to other features, such as for example to another rolling product material. Moreover, the known type of the roller guides has a significant gap in the region of the adjusting mechanical structure, which causes inaccuracies during the adjustment of the roller. Furthermore, for the adjustment of the rollers, important contact surfaces of the adjusting mechanical structure are subjected to dirt and cooling water, which after a long use time can cause further inaccuracies during the adjustment of the rollers. Most importantly, the known construction has the disadvantage that between the adjusting member, which is actuated for the central adjustment of the rollers, and the rollers a non-linear transmission characteristic relationship is provided, which leads either to an inaccurate adjustment of the rollers or requires an expensive control for compensation of the non-linearity.

SUMMARY OF THE INVENTION

Accordingly, it is an object of the present invention to provide a roller guide of the above mentioned general type, which however is not subjected to the above mentioned disadvantages, but instead with small axial dimensions provides an accurate adjustment of the rollers and an unobjectionable guidance of the roller product.

In keeping of these objects and with others which will become apparent herein after, one feature of present invention resides, briefly stated, in a roller guide in which between an adjusting bushing and each lever, a coupling rod is arranged, which hingedly engages with a leg of the lever facing away from the roller, and between the engaging point of the coupling rod with the lever and the rotary axis of the roller, an enclosed angle having an apex point on the turning axis of the turning pin has an angle between 88° and 92°.

With the inventive value of the preselected angle, an approximately linear transmission characteristic is provided between the adjusting member which acts for joint adjustment of the rollers and the rollers, and thereby a predetermined adjusting path on the adjusting member also causes always a same adjusting path of the rollers. The remaining nonlinearity is very small. It is produced by a small turning movement of the coupling rod during adjustment. In order to reduce also this small remaining non-linearity, the basic angular value of 90° inside the inventive region is deviated. With an adjusting member which is actuatable by hand, an indicating device located on it corresponds in each roller position to the axial adjustment. With a motor-activated adjusting member, each revolution of the adjusting motor, independently from the corresponding position of the rollers, actuates always the same adjustment path of the rollers. This makes possible an accurate joint adjustment of the rollers, for example during a change of the cross-section dimensions of the rolling product.

With the inventive use of a coupling rod, on each lever it is possible in addition to the joint adjustment to provide a separate adjustment of each individual roller. This is first of all needed for the first mounting of the roller guide for centering of the caliber opening of the rollers, and can be also required later. Moreover, the inventive construction permits the arrangement of devices for changing of the spring characteristic during the elastic expansion of the caliber opening of the rollers and thereby an adaptation of the roller guide to the various features of the practical operation. Furthermore, with the use of coupling rods, the important contact surfaces of the adjusting mechanical structure can be reliably sealed from dirt and cooling water, so that the adjusting accuracy and the accessibility remains the same after a certain time.

In accordance with a preferable embodiment of the present invention, the coupling rods have an end which faces away from the lever and engages a flange part of the adjusting bushing. Therefore the axial displacing movement of the adjusting bushing can be transferred without problems synchronously to all levers, and all rollers can be jointly adjusted. It is recommended to engage the coupling rods on the flange part of the adjusting bushing through an adjusting element which is arranged there and is displaceable relative to it in direction of the roll axis. The adjusting element makes possible adjustment of each coupling rod in particular in direction of the roller axis and thereby turning of only one associated angular lever for radial adjustment of only one roller supported in it.

It is especially advantageous to arrange a spring element which is adjustable with regard to its pretensioning and its characteristic, between the leg of the lever facing away from the roller and the adjusting bushing. The spring element determines an elastic expansion of the caliber opening of the rollers during passage of the rolling product and thereby the forces with which the rollers abut against the rolling product. Since each spring characteristic is changeable, for example by changing the spring element, in an advantageous manner it is possible to change the spring characteristic line of the elastic expansion of the caliber opening of the rollers. Therefore it is recommended to arrange the spring element in a cup-shaped exchangeable bushing in the leg of the lever which faces away from the roller. This makes possible a fast exchange of the spring element and protection from dirt and cooling water.

In accordance with a further embodiment of the present invention, a spring which moves the roller away from the rolling product is provided between the leg of the lever which carries the roller and a housing part of the roller guide. With this spring, the gap in the adjusting mechanical structure is eliminated, when no rolling product is located in the caliber opening of the rollers, and the corresponding roller is held in a definite initial position.

It is advantageous to provide the adjusting bush with an outer thread and to engage a turnable and axially arrestable drive ring in an inner thread. The drive ring can be driven by a motor or manually. By turning of the drive ring, the adjusting bushing is displaced in direction of the roll axis and thereby the rollers are synchronously radially offset. This construction makes possible small axial sizes of the roller guide, which is thereby suitable for roll trains with short distance between the roll stands.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
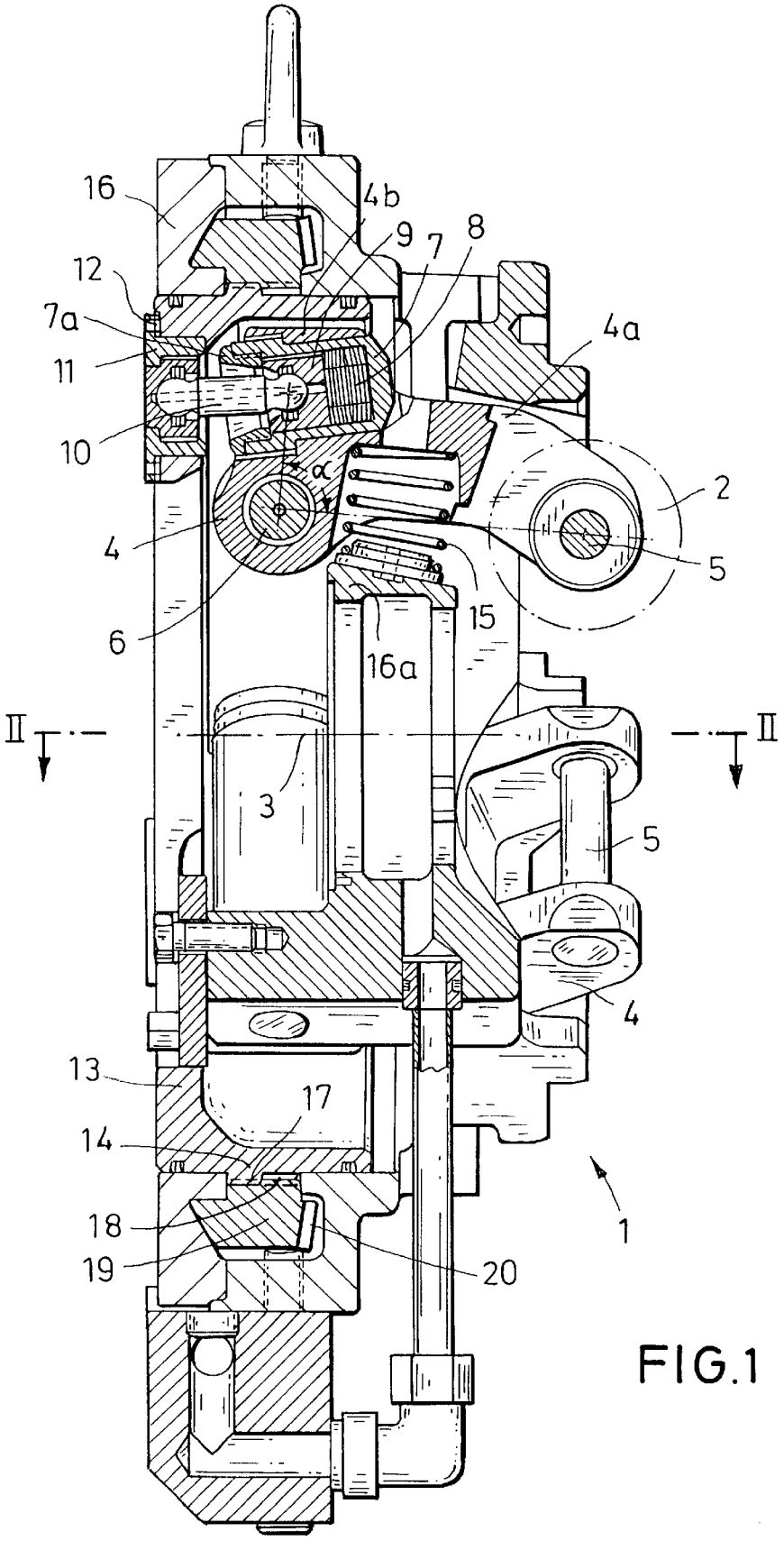
FIG. 1 is a views howing a roller guide in accordance with the present invention in an axial longitudinal section.

A roller guide shown in FIG. 1 is identified with reference numeral 1. It has three rollers 2, while of course another number of rollers 2 can be used as well. The rollers are arranged around a roll axis 3. The roll axis 3 is also a central axis of two caliber openings which are formed at one hand by the rollers 2 of the roller guide 1 and on the other hand by not shown rolls of a roll stand. The rollers 2 are offset relative to one another around the roll axis 3 by 120°. From the three rollers 2 in FIG. 1, only one roller is illustrated, which is located above the roll axis 3.

The rollers 2 are arranged each on a lever 4 which is formed as an angular lever. Each lever 4 carries its rollers 2 rotatably on an end of a leg 4*a*, on a bearing pin 5. The lever 4 is turnable in a central longitudinal portion around a turning pin 6. The turning axis of the turning pin 6 extends transversely to the roll axis 3.

A leg 4*b* of the lever 4 which is opposite to the roller 2 carries a cup-shaped bushing 7 which is exchangeably inserted in an opening. A spring element 8 is located in the bushing 7 and is composed here of plate springs. The plate springs abut against a bottom of the bushing 7 and against an axially displaceable bearing member 9 in the bushing 7. The bearing member 9 is held at a side facing away from the spring element 8 by a holding ring 7*a* which is screwed in the bushing 7 for changing the magnitude of the tensioning of the spring element 8.

At the, end facing away from the spring element 8, the bearing member 9 centrally is provided with a depression in form of a spherical trough. A coupling rod 10 is hingedly supported with its spherical end in the spherical trough. In the same way, the other also spherical end of the coupling rod 10 is supported in an adjusting element 11. The adjusting element is adjustable by, spacers 12 of different thicknesses relative to a flange part 13 of an adjusting bushing 14 in direction of the roll axis 3.

The spring 15 has one end abutting against a housing part 16*a* and another end abutting against an inner side of the leg 4*a* of the lever 4. Thereby the lever 4 and thereby the roller 2 assume a definite initial position, when no rolling product is located in the roller guide 1 and a pressure pretensioning acts on the coupling rod 10. Thereby lifting of the same from the spherical trough is avoided.

In order to individually adjust the rollers 2 relative to the roll axis 3, the spacers 12 of the adjusting element 11 are replaced with spacers of different thicknesses. Thicker spacers 12 act for an increase of the caliber opening. Such an adjustment is necessary after the first mounting of the roller guide 11 only seldom. Frequently, at least during each dimension exchange of the rolling product, a joint displacement of all rollers 2 is necessary. For this purpose, the adjusting bushing 14 is displaced in the housing 16 of the roller guide 1 in direction of the roll axis 3 and thereby its flange part 13 is displaced as well. The coupling rods 10 which are supported through the adjusting element 11 are also displaced in the direction of the roll axis 3, and the lever 4 is turned correspondingly about the turning axis and turning pin 6. Depending on the direction of the displacement of the adjusting bushing 14, the rollers 2 can be displaced away from the roll axis 3 or toward it. Since the angle identified with $\alpha$ is enclosed between the engaging point of the coupling rod 10 on the lever 4 and the rotary axis of the roller 2 with its apex point located on the turning axis of the turning pin 6, amounts to approximately 90°, a linear transmission characteristic of the adjusting mechanical structure is provided.

For axially displacing the adjusting bushing 14 in the housing 16 of the roller guide 1, it is provided on its outer surface with an outer thread 17 and engages with it in an inner thread 18 of a drive ring 19. Since the adjusting bushing 14 is secured from rotation, and the drive ring 19 is secured from the axial movement, then during turning of the driving ring 19 the adjusting bushing 14 displaces in the axial direction.

Figure 2:
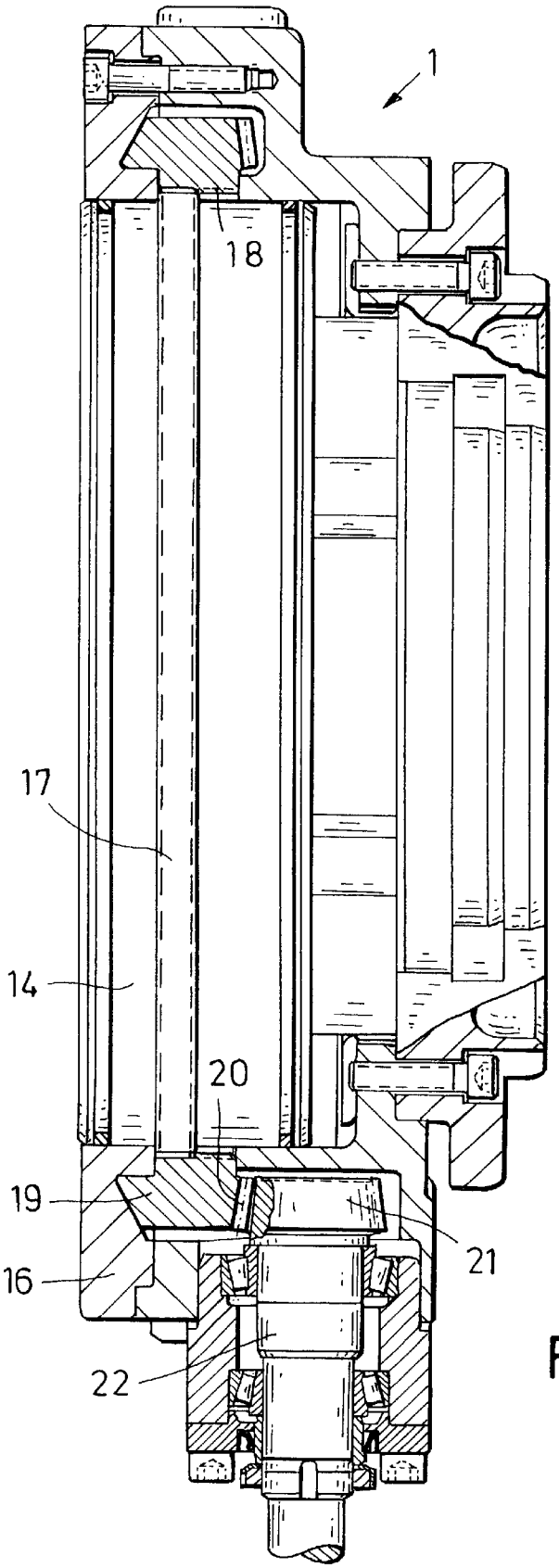
FIG. 2 is a view showing a section of the inventive roller guide taken along the line 11—11 in FIG. 1.

FIG. 2 illustrates the drive of the driving ring 19. The driving ring 19 has teeth 20 in which a pinion 21 engages. The pinion 21 is supported in the housing 16 of the roller guide 1. The pinion 21 is driven either manually or by an adjusting motor through a pinion shaft 22. The pinion shaft 22 is thereby the adjusting member of the roller guide 1.

It will be understood that each of the elements described above, or two or more together, may also find a useful application in other types of constructions differing from the types described above.

While the invention has been illustrated and described as embodied in roller guide for a roller stand, it is not intended to be limited to the details shown, since various modifications and structural changes may be made without departing in anyway from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

We claim:

1. A roller guide for a roll stand for precise guiding of a rod-shaped or wire-shaped rolling product in a caliber opening formed by rolls which engage the rolling product from an outer side and are distributed on a periphery of the rolling product, the roller guide comprising angular levers provided with legs on which the rollers are rotatably supported; turning pins on which said angular levers are turnable and which have turning axes extending transversely to a roll axis; an adjusting bushing by which said levers are jointly turnable so as to displace the rollers jointly radially to the roll axis; a coupling rod arranged between said adjusting bushing and each of said levers, said coupling rod being hingedly engaged on a leg of said lever which faces away from the rollers, and an angle between an engaging point between said coupling rod on said lever and a rotary axis of the roller with an apex point on said turning axis of said turning pin amounting to between 80 and 92°.

2. A roller guide as defined in claim 1, wherein said adjusting bushing has a flange part, said coupling rods having ends which face away from said lever and which hingedly engage said flange part of said adjusting bushing.

3. A roller guide as defined in claim 2, and further comprising an adjusting element which is adjustable in direction of the roll axis and through which said coupling rods engage said flange part of said adjusting bushing.

4. A roller guide as defined in claim 1, and further comprising a spring element which is arranged between a leg of said lever facing away from said roller and said adjusting bushing, said spring element having a changeable pre-tensioning and characteristic.

5. A roller guide as defined in claim 4, wherein a leg of said lever which faces away from the roller has a cup-shaped changeable bushing, said spring element being arranged on said cup-shaped exchangeable bushing.

6. A roller guide as defined in claim 1, and further comprising a spring provided between a leg of said lever which carries said roller and a housing part and moving the roller away from the rolling product.

7. A roller guide as defined in claim 1, and further comprising a rotatable and axially arrestable driving ring provided with an inner thread, said adjusting bushing being provided with an outer thread engaging said inner thread of said driving ring.

8. A roller guide as defined in claim 7, wherein said driving ring is motor drivable.

9. A roller guide as defined in claim 7, wherein said driving ring is manually drivable.

* * * * *